US005172778A

United States Patent [19]

Tibbitts et al.

[11] Patent Number: 5,172,778

[45] Date of Patent: Dec. 22, 1992

[54] DRILL BIT CUTTER AND METHOD FOR REDUCING PRESSURE LOADING OF CUTTERS

[75] Inventors: Gordon A. Tibbitts; Paul Pastusek, both of Salt Lake City, Utah

[73] Assignee: Baker-Hughes, Inc., Salt Lake City, Utah

[21] Appl. No.: 794,722

[22] Filed: Nov. 14, 1991

[51] Int. Cl.[5] ..... E21B 10/36

[52] U.S. Cl. ..... 175/420.1; 175/431

[58] Field of Search ..... 175/336, 379, 390, 391, 175/420.1, 430, 431, 432

[56] References Cited

U.S. PATENT DOCUMENTS

| | | | |
|---|---|---|---|
| 4,098,363 | 7/1978 | Rohde et al. | 175/391 X |
| 4,373,594 | 2/1983 | Barr | 175/391 X |
| 4,380,271 | 4/1983 | Baker et al. | 175/391 |
| 4,558,753 | 12/1985 | Barr | 175/329 |
| 4,593,777 | 6/1986 | Barr | 175/379 |
| 4,606,418 | 8/1986 | Thompson | 175/329 |
| 4,660,659 | 4/1987 | Short, Jr. et al. | 175/329 |
| 4,679,639 | 7/1987 | Barr et al. | 175/329 |
| 4,719,979 | 1/1988 | Jones | 175/329 |
| 4,727,946 | 3/1988 | Barr et al. | 175/379 |
| 4,858,707 | 8/1989 | Jones et al. | 175/329 |
| 4,872,520 | 10/1989 | Nelson | 175/329 |
| 4,883,132 | 11/1989 | Tibbitts | 175/65 |
| 4,981,184 | 1/1991 | Knowlton et al. | 175/397 X |
| 4,984,642 | 1/1991 | Renard et al. | 175/329 |
| 4,995,887 | 2/1991 | Barr et al. | 51/295 |
| 5,103,922 | 4/1992 | Jones | 175/429 |

FOREIGN PATENT DOCUMENTS

| | | |
|---|---|---|
| 2089415 | 1/1972 | France . |
| 2380845 | 9/1978 | France . |
| 1040850 | 11/1984 | U.S.S.R. . |
| 1351795 | 11/1987 | U.S.S.R. . |

*Primary Examiner*—Carl D. Friedman
*Assistant Examiner*—Roger J. Schoeppel
*Attorney, Agent, or Firm*—Marger, Johnson, McCollom & Stolowitz

[57] ABSTRACT

A drag-type drill bit for boring an earth formation having a plurality of cutting elements formed thereon. Each cutting element includes a cutting surface having a cutting edge formed thereon. During boring, the cutting edge is embedded into an earth formation so that the formation is received against a portion of the cutting surface. As the cutting surface advances against the formation, a chip forms. The chip has a first surface directed generally toward the cutting surface and a second surface directed generally in the direction of cutting element travel. A number of different embodiments are disclosed which include means formed on and in the cutting surface for communicating drilling fluid pressure via slots or discontinuities to a location on the cutting surface relatively close to the cutting edge. Drilling fluid pressure across the chip is thus equalized thereby preventing the chip from being urged against the cutting surface due to the difference between the formation pressure and the drilling fluid pressure.

24 Claims, 2 Drawing Sheets

DRILL BIT CUTTER AND METHOD FOR REDUCING PRESSURE LOADING OF CUTTERS

BACKGROUND OF THE INVENTION

1. Field of the Invention

The present invention relates to the field of earth boring tools and more particularly to rotating drag bits and the cutters contained thereon.

2. Description of the Related Art

Drilling in shale or plastic formations with a drag bit has always been difficult. The shale, under pressure and in contact with hydraulics, tends to act like a sticky mass, sometimes referred to as gumbo, which balls and clogs the bit. Once the bit balls up, it ceases to cut effectively.

One type of drag bit includes polycrystalline diamond compact (PDC) cutters which present a generally planar cutting face having a generally circular perimeter. A cutting edge is formed on one side of the cutting face which, during boring, is at least partially embedded into the formation so that the formation is received against at least a portion of the cutting surface. As the bit rotates, the cutting face moves against the formation and a chip, which rides up the surface of the face, forms. When the bit is functioning properly, the chip breaks off from the remainder of the formation and is transported out of the bore hole via circulating drilling fluid. Another chip begins to form, also sliding up the face of the cutting surface and breaking off in a similar fashion. Such action occurring at each cutting element on the bit causes the bore to become progressively deeper.

In low permeability formations, however, drilling fluid is not transported far into the formation. There can thus be a pressure difference in the range of 20,000 psi between the well bore, which is under pressure from the drilling fluid, and the rock pores near the bore. As the bit rotates, rock pore pressure appears between that portion of the cutting face embedded into the formation and the chip riding up the cutting face. Because well bore pressure appears on the other side of the chip it is effectively plastered against the cutting surface by the pressure differential. Friction between the chip and the face of the cutter increases proportional to the pressure differential across the chip. Thus, when there is a high pressure differential, the chip is compressed by a force generated by the pressure differential across the chip which acts to increase friction for opposing the direction of the sliding chip on the face of the cutter. The sliding movement of the chip over the cutter is thus slowed and the bit becomes balled and clogged by the rock being bored. Furthermore, bit balling compresses the formation being cut thus making cutting more difficult.

Although not all prior art cutting element surfaces are planar, none are known which provide fluid communication to a location closely adjacent that portion of the cutting surface embedded in the formation thereby relieving the pressure differential across the chip. For example, U.S. Pat. No. 4,872,520 to Nelson discloses a flat bottom drilling bit with polycrystalline cutters. These cutters are shaped to provide a cutting edge which does not wear flat even when the cutter is worn. U.S. Pat. Nos. 4,558,753; 4,593,777; and 4,660,659 similarly disclose a drag bit and cutters which maintain a sharp cutting edge even as the cutting elements wear. U.S. Pat. No. 4,984,642 to Renard et al. utilizes a cutter having corrugations formed thereon. These corrugations, however, are defined by gradually sloping walls having an angle of approximately 45 degrees relative the cutting surface. This structure permits rock to be urged into the corrugations and against the walls thereby enabling a high pressure differential across rock chips cut by the bit and thus causing the resulting problems as described above.

SUMMARY OF THE INVENTION

The present invention comprises a drag-type drill bit for boring an earth formation which includes a bit body having an operating face. A plurality of cutting elements are formed on the operating face and means are provided for circulating drilling fluid around the cutting elements during drilling. Each cutting element includes a cutting surface having a cutting edge formed thereon. During boring of an earth formation, the cutting edge is embedded therein so that the formation is received against a portion of the cutting surface. The cutting element creates a formation chip having a first surface directed generally toward the cutting element and a second surface directed generally in the direction of cutting element travel. Means are provided for minimizing the pressure difference between the first and second chip surfaces.

The present invention overcomes the above-enumerated disadvantages associated with prior art drag-type drill bits. More specifically, the present invention prevents balling or clogging of drag-type drill bits by reducing the area of the cutting surface thereby reducing the pressure differential across the chip and thus the shear force which opposes chip movement along the cutting surface. In addition, the present invention communicates drilling fluid pressure between the chip and the cutting surface at a location closely adjacent the cutting edge which also reduces the pressure differential with the resulting advantages.

The foregoing and other features and advantages of the invention will become more readily apparent from the following detailed description of a preferred embodiment which proceeds with reference to the drawings.

DETAILED DESCRIPTION OF THE PREFERRED EMBODIMENTS

Figures 1, 2, 3, 4, 5, 6:
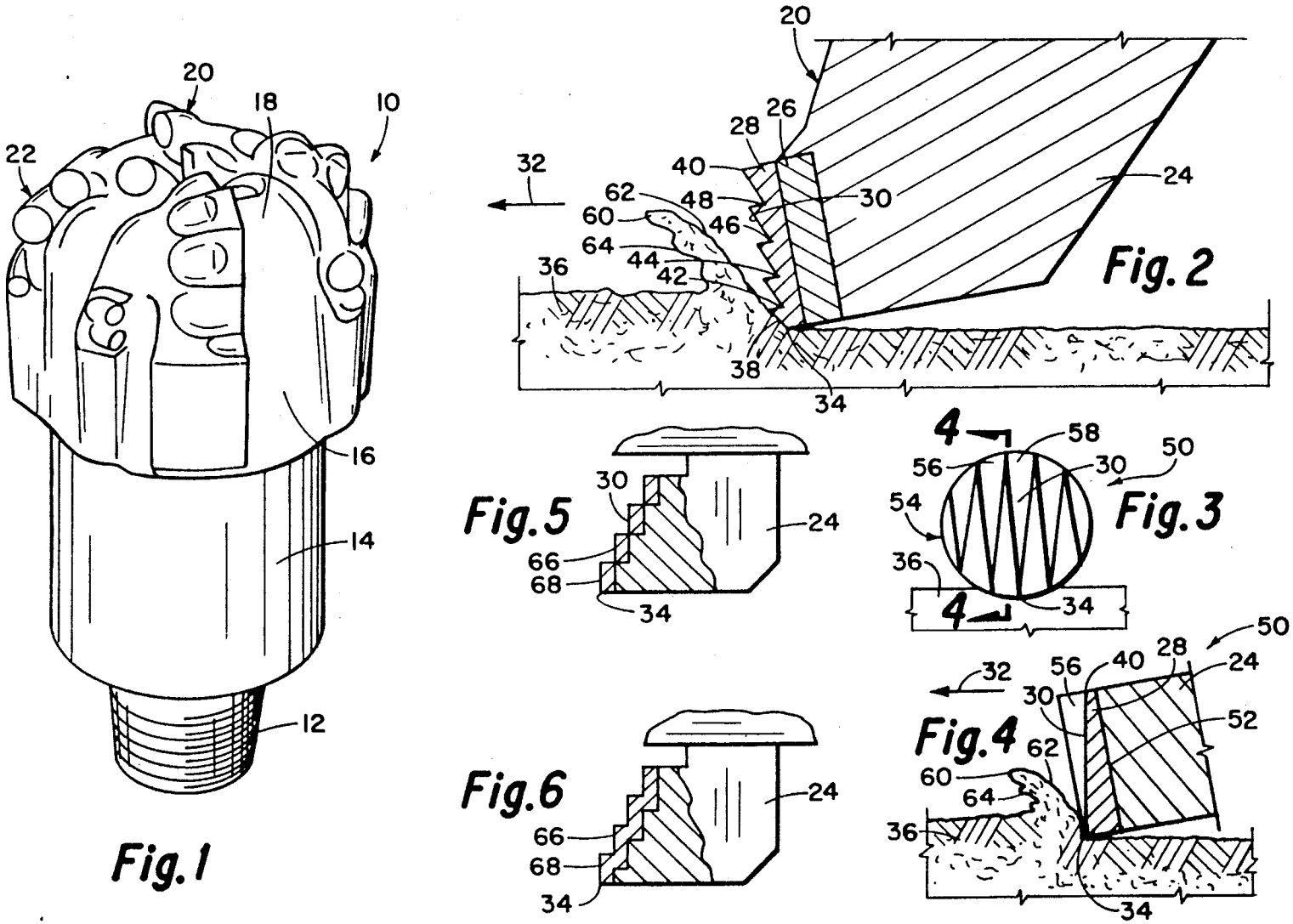
FIG. 1 is a perspective view of a drag bit incorporating the present invention.
FIG. 2 is an enlarged highly diagrammatic sectional view illustrating the cutting action of one cutting element of the bit in FIG. 1.
FIG. 3 is a view of a cutting element cutting surface in a second embodiment of the invention.
FIG. 4 is a highly diagrammatic view illustrating the cutting action of the cutting element of FIG. 3 taken along line 4—4 in FIG. 3.
FIG. 5 is a partial view of a third embodiment constructed in accordance with the present invention.
FIG. 6 is a partial view of a fourth embodiment constructed in accordance with the present invention.

Indicated generally at 10 in FIG. 1 is a drill bit constructed in accordance with the present invention. Bit 10 includes a threaded portion 12 on the upper end thereof (inverted in FIG. 1 for easy visualization). Threaded portion 12 is integral with a shank 14 which in turn is integral with a bit body 16. An operating face 18 is formed on the bit body and includes openings therein (not visible) for drilling fluid which is pumped down a dril string (not shown) to which the bit is attached. The circulating drilling fluid cools the cutters and washes cuttings or chips from under the bit face and up the borehole during drilling.

A plurality of cutting elements, like cutting elements 20, 22 are formed on operating face 18. Each cutting element includes a cutter body 24 (in FIG. 2) which is integrally formed as a part of bit body 16 but which may be attached thereto by interference fitting techniques, brazing, etc. In the present implementation of the invention, a backing slug 26 is set within cutter body 24 and a polycrystalline synthetic diamond table 28 is mounted, bonded or otherwise fixed to slug 26. Another method for mounting a diamond cutting surface is chemical deposition (CVD) diamond film coating. This is an advantageous method, although not the exclusive method, of forming a cutter surface in accordance with the present invention due to the irregularity of the cutting surface.

It is to be expressly understood that many other types of cutting elements or diamond cutters, e.g., natural diamond, thermally stable polycrystalline diamond or bonded stud cutters, could be substituted without departing from the spirit and scope of the invention.

Diamond table 28 includes a cutting surface 30 which presents a generally circular perimeter in the direction of travel of the cutting surface when bit 10 is boring an earth formation. The direction of travel is denoted by an arrow 32 in FIG. 2.

The lower perimeter of cutting surface 30 defines a cutting edge 34 which is embedded part way into an earth formation 36. As a result of being so embedded, when cutting element 20 moves in the direction of arrow 32, the earth formation is received against a lower portion 38 of cutting surface 30. Cutting surface 30 includes an edge 40 which defines an upper boundary of the perimeter of the cutting surface.

A plurality of laterally extending grooves 42, 44, 46, 48 are formed across cutting surface 30 with the opposing ends of each groove being coextensive with the perimeter of cutting surface 30. Each of the grooves, like groove 42, form what is referred to herein as a flow channel wall which extends at substantially ninety degrees to the cutting surface.

Each of the other cutting elements, like element 22, in bit 10 are formed similarly to cutting element 20. Of course, depending upon the location of each cutting element, the cutting surface may assume different angles relative to the cutter body than for that shown in FIG. 2. It should also be noted that the angle formed by lower portion 38 of the cutting surface can be varied to provide variation in rake angles of each cutter.

Prior to describing the operation of the embodiment of FIGS. 1 and 2, description will be made of the structure of a second cutting element 50, illustrated in FIGS. 3 and 4, also constructed in accordance with the invention. Like numerals in each figure denote the same structure.

In cutting element 50, PDC table 28 includes a cutting surface 30 which is angled relative to a back surface 52 of the PDC table. PDC table 28 is mounted directly on cutter body 24 in the embodiment of FIGS. 3 and 4. Additionally, a tungsten carbide element 54 having a plurality of downwardly extending tapered fingers, two of which are fingers 56, 58 is mounted on surface 30. The embodiment of FIGS. 3 and 4 could be equally well implemented with element 54 being made of polycrystalline diamond and being integrally formed with table 28. As best viewed in FIG. 4, each of the fingers is tapered complementary to surface 30 and defines slots therebetween which extend from the lower perimeter of cutting surface 30 to a point near the upper perimeter thereof.

Consideration will now be given to the manner in which cutting elements 20, 50 operate. When bit 10 is lowered into a well bore and set on the lower end thereof, the cutting edges of each cutting element are embedded in the earth formation a small amount as illustrated in FIGS. 2 and 4. When conventional fluid circulation begins, drilling fluid circulates out the lower end of the bit, into the annulus between the drill string and the well bore and up the annulus thus cooling the cutters and flushing the cuttings from the bore. As can be appreciated, the deeper the well bore, the higher the fluid pressure at the lower end of the bore where the bit is cutting.

When drill string rotation begins, the bit turns and the cutting elements begin cutting chips from the formation, like chips 60 in both FIGS. 2 and 4. Chip 60 has a first chip surface 62 directed generally toward cutting element 20 and a second chip surface 64 directed generally in the direction of cutting element travel.

In a deep well bore, the pressure differential between the surface of the bore against which surface fluid pressure is exerted and the pressure in the rock pores near the bore surface can be very high, in the order of thousands of pounds per square inch. It can thus be seen, e.g., in FIG. 4, that as the cutting element cuts, formation pressure is exerted against cutting surface 30 adjacent the lowermost portion thereof, i.e., near cutting edge 34 between chip surface 62 and the cutting surface. Drilling fluid pressure, on the other hand, is exerted against chip surface 64. In prior art cutting elements, the cutting surface is typically planar, although not always. Prior art non-planar cutting surfaces are generally curved as in, e.g., U.S. Pat. No. 4,660,659 to Short, Jr. et al. In such curved or planar prior art cutting surfaces, as the cutting element advances thereby causing a chip, like chip 60, to ride up the cutting surface, drilling fluid pressure tends to force the chip against the cutting surface, which is at the pressure of the pores in the rock being cut. As referred to above, this pressure differential creates a shear stress in the chip which prevents effective cutting of the earth formation and tends to cause balling of the bit, especially in sticky plastic formations.

Cutting elements 20, 50, constructed in accordance with the present invention, provide a means for minimizing the pressure differential between chip surfaces 62, 64. The pressure is equalized by communicating drilling fluid pressure to the first chip surface relatively close to the cutting edge. In the embodiment of FIG. 2, such drilling fluid pressure is communicated laterally along surface 30 from the perimeter of PDC table 28 along the grooves, especially grooves 42, 44. Because of the relatively small cutting surface presented by lower portion 38, the differential pressure force across the chip is also reduced. This substantially reduces shear stresses in the chip and therefore permits cutting at a much more effective rate. It should be noted that as portion 38 and cutting edge 34 are worn, the chip is urged against the cutting surface immediately above groove 42 thus maintaining a cutting surface having a relatively small surface area providing the same rake angle.

Similarly, in FIG. 4, the slots between fingers 56, 58 communicate fluid pressure along cutting surface 30 to a location closely adjacent cutting edge 34. Chip 60 in FIG. 4 is thus not plastered against the cutting surface.

The remaining embodiments, illustrated in FIGS. 5–22 also include like numerals to indicate similar structure to that previously described in connection with the first and second embodiments. It should be recalled that the common theme in each embodiment is discontinuities formed on or in the cutting surface which communicate drilling fluid and its associated pressure to a location on the cutting surface closely adjacent the cutting edge thus equalizing or reducing the pressure across a substantial portion of a formation chip formed during cutting action.

The cutting elements of FIGS. 5 and 6 each include a plurality of lateral steps, like steps 66, 68 which together form cutting surface 30.

In each of the embodiments of FIGS. 5 and 6, step 68 is the forward-most extending step with cutting edge 34 being formed thereon. The embodiment of FIG. 5 is a brazed cutter with individual PDC elements, each of which makes up a step, being mounted on the cutter body via brazing. The embodiment of FIG. 6 is a formed geometry cutter with the polycrystalline diamond being formed to produce the stepped cross-section illustrated in FIG. 6 and being mounted on or bonded to cutter body 24. CVD or other techniques are equally suitable for providing a cutting edge in the present invention.

During drilling, rock is cut by edge 34. Such cutting forms a chip which slides up the face of step 68. During drilling step 68 wears until cutting is accomplished by the lower edge of step 66 thus presenting a new sharp cutting edge. As will be recalled, the pressure between the chip and the surface of the cutting surface, step 68 in FIG. 5, is equal to the pressure in the pores of the rock through which the bit is drilling while the pressure exerted on the surface of the chip exposed to the well bore is equal to the drilling fluid pressure. A normal force thus urges the chip against the cutting surface. As cutting occurs, the chip is urged along the cutting surface. Because of friction between the cutting surface and the chip, a shear force proportional to the normal force opposes chip movement along the cutting surface and thereby compresses the chip making cutting more difficult and ultimately causing bit clogging in prior art bits. In the embodiments of FIGS. 5 and 6, however, the surface area of each of the cutting surfaces is much smaller than the cutting surface presented by a prior art bit. Because the cutting surface is smaller, the normal force generated by the pressure differential is also smaller thus reducing the shear force in the chip and thereby alleviating the tendency of the bit to clog.

Figure 7:
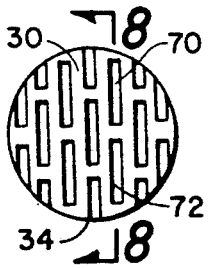
FIG. 7 is a view of a cutting element cutting surface in a fifth embodiment of the invention.
Figure 8:
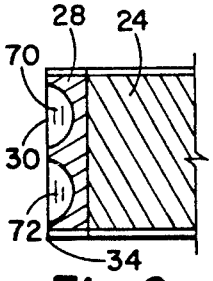
FIG. 8 is a view taken along 8—8 in FIG. 7.

In the embodiment of FIGS. 7 and 8, a plurality of slots, like slots 70, 72 are formed in PDC table 28. Each of the slots has a cross-section as illustrated in FIG. 8. During cutting, edge 34 is embedded in the formation with the chip being formed against cutting surface 30 as the bit rotates. Drilling fluid is communicated into the upper portions of the slots, like slot 72, and is communicated from there to cutting surface 30 adjacent a lower portion of the slot thereby equalizing the pressure across the chip at a point relatively close to cutting edge 34. The chip thus is permitted to slide off of or move away from cutting surface 30, under a shear force exerted by the sliding of the next formation chip onto the lower portion of the cutting surface, as illustrated in FIGS. 2 and 4.

Figure 9:
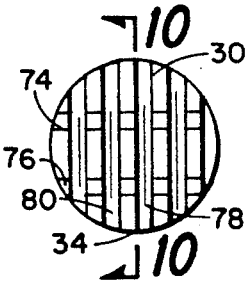
FIG. 9 is a view of a cutting element cutting surface in a sixth embodiment of the invention.
Figure 10:
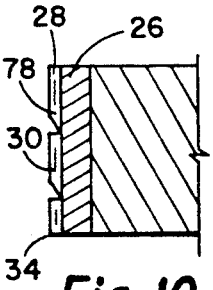
FIG. 10 is a view taken along lines 10—10 in FIG. 9.

FIGS. 9 and 10 include both horizontal slots, like slots 74, 76 and vertical slots, like slots 78, 80 all of which communicate drilling fluid to surface 30 to equalize pressure against the chip as previously described.

Figure 11:
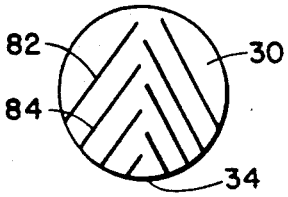
FIG. 11 is a view of a cutting element cutting surface in a seventh embodiment of the invention.
Figure 14:
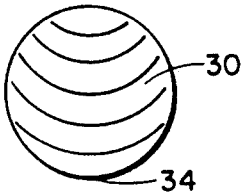
FIG. 14 is a view of a cutting element cutting surface in a ninth embodiment of the invention.
Figure 15:
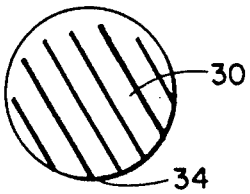
FIG. 15 is a view of a cutting element cutting surface in a tenth embodiment of the invention.

FIGS. 11, 14 and 15 illustrate embodiments in which the forward-directed portion of the PDC table upon which cutting surface 30 is formed includes scores, like scores 82, 84 in FIG. 11, which function as slots to communicate drilling fluid from a location generally away from the cutting edge to a location on surface 30 closer to the cutting edge to prevent pressure loading of the chip against surface 30. The embodiments of FIGS. 11, 14 and 15, as can others of the disclosed embodiments of the present invention, can be implemented with a cutting surface having a convex or concave hemispherical shape, which is a cutting element shape known in the art. It is also possible to implement the present invention in a cutter having a non-round perimeter, e.g., one having a perimeter defined by straight edges or having a portion thereof defined by one or more straight edges.

Figure 12:
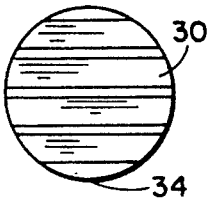
FIG. 12 is a view of a cutting element cutting surface in an eighth embodiment of the invention.
Figure 13:
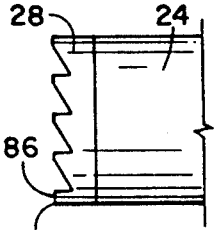
FIG. 13 is a right-side elevational view of the cutting element of FIG. 12.

The embodiment of FIGS. 12 and 13 is similar to the embodiment of FIG. 2 except that a lower portion 86 at surface 30 adjacent cutting edge 34 includes a portion of the cutting surface normal to the axis of cutter body 24. The embodiment of FIGS. 12 and 13 operates generally in the same fashion as that of FIG. 2.

Figure 16:
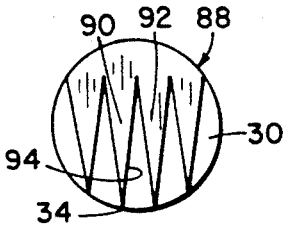
FIG. 16 is a veiw of a cutting element cutting surface in an eleventh embodiment of the invention.
Figure 17:
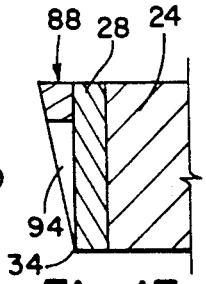
FIG. 17 is a view taken along line 17—17 in FIG. 16.

In the embodiment of FIGS. 16 and 17, a tungsten carbide coating 88 includes downwardly extending fingers, like fingers 90, 92, which define a fluid communication channel 94 therebetween. As can be seen in FIG. 17, coating 88 tapers from top to bottom and is bonded to PDC table 28. PDC table 28 comprises a disk having opposed parallel faces, with the forward-directed face having cutting surface 30 formed thereon. For the same mounting on a cutter body, the embodiments of FIGS. 4 and 17 present slightly different rake angles for cutting surface 30. Both embodiments operate in similar fashions, i.e., drilling fluid is communicated through the channels, like channel 94, formed between, e.g., fingers 90, 92, to cutting surface 30 relatively close to cutting edge 34 thereby equalizing pressure across a chip being formed by the cutting element during cutting action.

Figure 18:
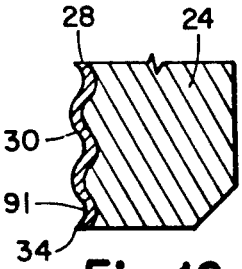
FIG. 18 is a partial view of a twelfth embodiment shown in cross-section.

FIG. 18 illustrates a cutter having a wave-shaped cross-section which also achieves the objects of the present invention. Included therein is a trough 91 which is substantially parallel to cutting edge 34. The cutting edge axis is considered to be the tangent to the cutting surface boundary which is most deeply embedded in the rock. Of course after some drilling, a flat is worn on the cutting element and the cutting edge axis is considered to be along the flat. Trough 91 causes the chip to be pushed out of the trough during drilling. The only surface area against which the chip is urged is in trough 91. The reduced area reduces shear forces in the chip thus making for faster and more efficient drilling. As wear occurs, this cutting action shifts to the next adjacent trough.

Figure 19:
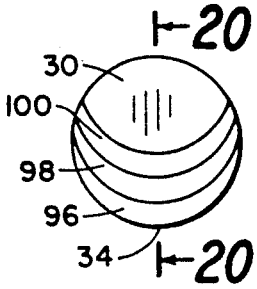
FIG. 19 is a veiw of a cutting element cutting surface in a thirteenth embodiment of the invention.
Figure 20:
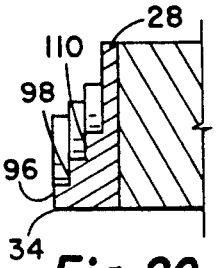
FIG. 20 is a view taken along lines 20—20 in FIG. 19.

The embodiment of FIGS. 19 and 20 includes arcuate steps 96, 98, 100 which permit communication of drilling fluid to cutting surface 30 just above step 96, as viewed in FIG. 20, thereby equalizing pressure across the chip formed during cutting action.

Figure 21:
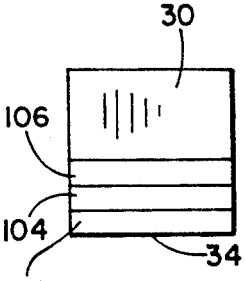
FIG. 21 is a view of a cutting element cutting surface in a fourteenth embodiment of the invention.
Figure 22:
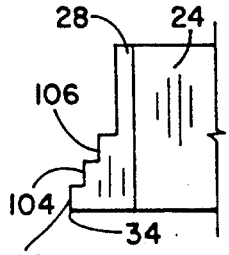
FIG. 22 is a right-side elevational view of the cutting element of FIG. 21.

The embodiment of FIGS. 21 and 22 also includes steps 102, 104, 106 which achieve generally the same ends as the stepped embodiments of FIGS. 5 and 6.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

We claim:

1. A drag-type drill bit for boring an earth formation comprising:

a bit body having an operating face;

a plurality of cutting elements formed on said operating face;

means for circulating drilling fluid around the cutting elements during drilling;

a cutting surface formed on each cutting element;

a cutting edge formed on each cutting surface and being embedded in the earth formation during boring so that the formation is received against a portion of said cutting surface, said cutting element creating a formation chip having a first surface directed generally toward the cutting element and a second surface directed generally in the direction of cutting element travel when said bit body is operatively rotated, said second surface being exposed to drilling fluid pressure and said first surface being exposed to a lower formation pressure; and means for minimizing the pressure differential between said first and second chip surfaces, said minimizing means comprising a plurality of steps formed on said cutting surface and having surfaces oriented generally in the direction of cutting element travel, said cutting edge being formed on the forward-most extending step.

2. A drag-type drill bit for boring an earth formation comprising:

a bit body having an operating face;

a plurality of cutting elements formed on said operating face;

means for circulating drilling fluid around the cutting elements during drilling;

a cutting surface formed on each cutting element;

a cutting edge formed on each cutting surface and being embedded in the earth formation during boring so that the formation is received against a portion of said cutting surface, said cutting element creating a formation chip having a first surface directed generally toward the cutting element and a second surface directed generally in the direction of cutting element travel when said bit body is operatively rotated, said second surface being exposed to drilling fluid pressure and said first surface being exposed to a lower formation pressure; and means for minimizing the pressure differential between said first and second chip surfaces.

3. The drill bit of claim 2 wherein said minimizing means comprises means for communicating drilling fluid pressure to said first chip surface.

4. The drill bit of claim 3 wherein said minimizing means comprises means for communicating drilling fluid to said first chip surface relatively close to said cutting edge.

5. The drill bit of claim 4 wherein said communicating means comprises a flow channel having at least one wall which is at an angle of substantially 90° to the cutting surface.

6. The drill bit of claim 5 wherein said communicating means comprises slots formed in said cutting element.

7. The drill bit of claim 5 wherein said communicating means comprises means formed on said cutting surface defining fluid communication channels.

8. The drill bit of claim 5 wherein said cutting surface is hemispherically shaped.

9. The drill bit of claim 5 wherein said flow channel further comprises a second wall which is at an angle of substantially 90° to said cutting surface, said second wall being generally opposite said first-mentioned wall.

10. The drill bit of claim 9 wherein said walls are substantially parallel to one another.

11. The drill bit of claim 9 wherein said walls are angled relative to one another.

12. The drill bit of claim 2 wherein said minimizing means comprises an elongate channel located closely adjacent said cutting edge and substantially parallel to the axis of the cutting edge.

13. The drill bit of claim 2 wherein said means for minimizing the pressure differential between said first and second chip surfaces comprises a flow channel formed on said cutting surface and extending to a location closely adjacent said cutting edge, said flow channel having at least one wall which is at an angle of substantially 90° to said cutting surface for communicating drilling fluid pressure to the first surface of such a chip whereby drilling fluid pressure communicated to the first surface via said flow channel tends to equalize the pressure between the first and second chip surfaces.

14. The drill bit of claim 13 wherein said walls are angled relative to one another.

15. The drill bit of claim 13 wherein said walls are substantially parallel to one another.

16. A drag-type drill bit for boring an earth formation comprising:

a bit body having an operating face;

a plurality of cutting elements formed on said operating face;

means for circulating drilling fluid around the cutting elements during drilling;

a cutting surface formed on each cutting element;

a cutting edge formed on each cutting surface and being embedded in the earth formation during boring so that the formation is received against a portion of said cutting surface; and an elongate, concave trough formed on said cutting surface adjacent said cutting edge, said trough being substantially parallel to said cutting edge.

17. The drill bit of claim 16 wherein said cutting surface has a sinusoidal cross-section along an axis normal to said cutting edge and wherein said trough defines a portion of said cross-section adjacent the cutting edge.

18. An improved cutting element for a drag-type drill bit for boring an earth formation comprising:

a cutting surface formed on the cutting element;

a cutting edge formed on the cutting element at a boundary of the cutting surface;

means formed on said cutting element for permitting fluid communication between a first location relatively close to said cutting edge and a second location relatively close to another. boundary of said cutting surface, said means including a wall which forms an angle of substantially 90° relative to said cutting surface.

19. The cutting element of claim 18 wherein said means for permitting fluid communication comprises means for permitting fluid communication between a first location relatively close to said cutting edge and a second location relatively close to a boundary of said cutting surface generally opposite said cutting edge.

20. The cutting element of claim 19 wherein said means for permitting fluid communication comprises slots formed in said cutting element.

21. The cutting element of claim 19 wherein said means for permitting fluid communication comprises means formed on said cutting surface defining fluid communication channels.

22. The drill bit of claim 18 wherein said means formed on said cutting element for permitting fluid communication between a first location relatively close to said cutting edge and a second location relatively close to another boundary of said cutting surface further comprises a second wall which forms an angle of substantially 90° relative to said cutting surface, said second wall being generally opposed from said first-mentioned wall.

23. The drill bit of claim 18 wherein said cutting surface is hemispherically shaped.

24. An improved cutting element for a drag-type drill bit for boring an earth formation comprising:

a cutting surface formed on the cutting element:

a cutting edge formed on the cutting element at a boundary of the cutting surface;

means formed on said cutting element for permitting fluid communication between a first location relatively close to said cutting edge and a second location relatively close to another boundary of said cutting surface, said means including a wall which forms an angle of substantially 90° relative to said cutting surface and a plurality of steps formed on said cutting surface and having surfaces oriented generally in the direction of cutting element travel during boring, said cutting edge being formed on the forward-most extending step.

* * * * *

UNITED STATES PATENT AND TRADEMARK OFFICE

CERTIFICATE OF CORRECTION

PATENT NO. : 5,172,778
DATED : December 22, 1992
INVENTOR(S) : Tibbitts et al.

It is certified that error appears in the above-indentified patent and that said Letters Patent is hereby corrected as shown below:

| | |
|---|---|
| Column 3 | Line 9, change "veiw" to --view--; |
| Column 3 | Line 14, change "veiw" to --view--; |
| Column 3 | Line 32, change "dril" to --drill--. |

Signed and Sealed this

First Day of March, 1994

Bruce Lehman

*Attest:*

BRUCE LEHMAN

*Attesting Officer*

*Commissioner of Patents and Trademarks*